United States Patent [19]

Hershkovitz et al.

[11] Patent Number: 5,077,549

[45] Date of Patent: Dec. 31, 1991

[54] INTEGRATING PASSIVE INFRARED INTRUSION DETECTOR

[76] Inventors: Shmuel Hershkovitz; Pinhas Shpater, both of 1435, Beverly Crescent, Chomedey Laval, Canada, H7W 3T6

[21] Appl. No.: 550,472

[22] Filed: Jul. 10, 1990

[30] Foreign Application Priority Data

Aug. 7, 1989 [CA] Canada ..... 607682

[51] Int. Cl.[5] ..... G08B 13/18

[52] U.S. Cl. ..... 340/567; 250/338.1; 250/340; 250/395

[58] Field of Search ..... 340/567; 250/340, 338.1, 250/395

[56] References Cited

U.S. PATENT DOCUMENTS

| | | | |
|---|---|---|---|
| 4,179,691 | 12/1979 | Keller | 340/567 |
| 4,612,442 | 9/1986 | Toshimichi | 250/353 |
| 4,672,206 | 6/1987 | Suzuki et al. | 250/342 |
| 4,697,081 | 9/1987 | Baker | 250/342 |
| 4,704,533 | 11/1987 | Rose et al. | 250/342 |
| 4,743,886 | 5/1988 | Steiner et al. | 340/514 |
| 4,745,284 | 5/1988 | Masuda et al. | 250/338.3 |
| 4,746,910 | 5/1988 | Pfister et al. | 340/567 |
| 4,752,768 | 6/1988 | Steers et al. | 340/567 |
| 4,764,755 | 8/1988 | Pedtke et al. | 340/541 |
| 4,769,545 | 9/1988 | Fraden | 250/353 |

OTHER PUBLICATIONS

Brochure on "Security Motion Detector Analyzer-the Parodox", Pirotec Technologies, Saint-Eustace (Quebec).

*Primary Examiner*—Glen R. Swann, III

*Attorney, Agent, or Firm*—Collard, Roe & Galgano

[57] ABSTRACT

In a passive infrared intrusion detection system, a signal responsive to infrared radiation received from optically divided zones of an area to be monitored is integrated to produce an integral sum. The integral sum is used to generate an alarm indication. The alarm indication is thereby responsive to the energy of the signal responsive to the infrared radiation received, thus improving sensitivity of the detection system without increasing susceptibility of generating a false alarm.

20 Claims, 2 Drawing Sheets

INTEGRATING PASSIVE INFRARED INTRUSION DETECTOR

FIELD OF THE INVENTION

The present invention relates to an improvement in a passive infrared intrusion detector or detection system which measures infrared rays emitted from an object so as to detect the intrusion of an object into a monitored zone.

BACKGROUND OF THE INVENTION

A passive infrared intrusion detector, as is known in the art, detects changes in the level of infrared rays impinging upon a passive infrared sensor which receives infrared rays from an area to be monitored through a lens device. The lens device optically divides the area into a plurality of zones from which rays can be received. The zones are separated from one another, so that when an object (i.e. a person or an object) is moved across the zones, the detector will receive rays from the object when the object is in one of the zones, and will receive rays only from the background when the object moves into the space between the zones. The result is a chopping or a flicker of infrared radiation received by the detector. The pyroelectric sensor then produces a signal in response to the chopping or flicker which can be processed to trigger an alarm.

The signal processing means to determine whether an alarm should be triggered or not, is a very important element in the detection system.

The most basic signal processing means is the use of a threshold, that is when the signal from the pyroelectric sensor has an amplitude which exceeds a preset level, the alarm is triggered. The basic threshold method is prone to lack of sensitivity and/or setting false alarms due to spurious background noise (e.g. heat emitted from sedentary objects or small animals such as mice).

Other more sophisticated signal processing means include requiring that the signal cross both a positive and a negative threshold as disclosed in U.S. Pat. No. 4,179,691, counting the number of times the signal crosses the threshold as disclosed in U.S. Pat. No. 4,764,755, and preventing a potential trigger when a signal exceeds a threshold for too little time (i.e. spikes) as disclosed in U.S. Pat. No. 4,612,442. The methods listed above are, however, still prone to lack of sensitivity or false alarms.

It is therefore an object of the present invention to provide an infrared intrusion detection system including a signal processing means, which is less prone to lack of sensitivity or false alarms.

SUMMARY OF THE INVENTION

According to the invention the energy of the pyroelectric signal over a time interval is measured, to determine if the energy of the signal is great enough to trigger an alarm. The energy of the pyroelectric signal is held to be a good indication of intrusion without being affected by background noise.

The present invention provides a passive infrared intrusion detection system to be connected to an alarm, comprising a collector for collecting infrared rays having an intensity from a plurality of optically divided detection zones of an area to be monitored, a detector for passively detecting the infrared rays collected by the collector, a signal generator for generating a signal responsive to the intensity of the infrared rays collected, an integrator for integrating the signal to produce an integral sum and for generating an output signal when the integral sum of the signal by the integrator during an integration period exceeds a preset value, and an alarm activator for activating the alarm in response to the output signal of the pulse integrator. Preferably, the signal generator may also generate pulses at a frequency in relation to the intensity of the infrared rays.

The present invention also provides a method of passive infrared intrusion detection, comprising the steps of collecting infrared rays having an intensity from a plurality of optically divided detection zones of an area to be monitored, detecting the infrared rays collected, generating a signal responsive to the intensity of the infrared rays detected, integrating the signal during an integration period to produce an integral sum, generating an output signal when the integral sum exceeds a preset value, activating an alarm in response to the output signal generated. Preferably, the second signal may be a train of pulses generated at a frequency given by a function of the intensity of the infrared rays.

BRIEF DESCRIPTION OF THE DRAWING

Further advantages and objects of the invention will become apparent by means of the following description of a preferred embodiment with reference to the drawings, in which.

DETAILED DESCRIPTION OF THE PREFERRED EMBODIMENT

Figure 1:
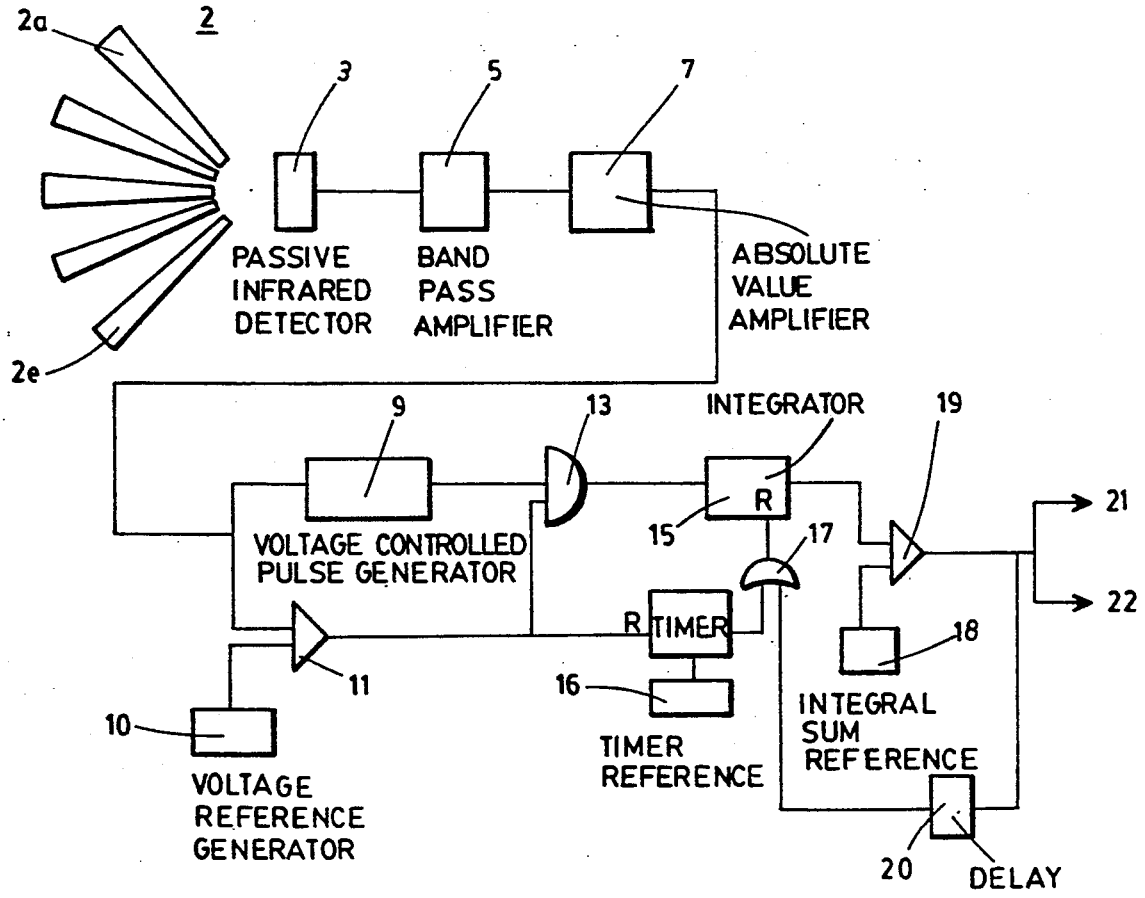
FIG. 1 is a block schematic diagram of a passive infrared instrusion detection system according to the preferred embodiment of the invention.

The passive infrared intrusion detection system according to the preferred embodiment, shown schematically in FIG. 1, has a passive infrared detector 3 which is provided with an infrared collecting lens and a pyroelectric sensor. The lens of the detector 3 will receive infrared light only from the zones 2a through 2e. The detector 3 will produce an electric signal in response to the change in intensity of the infrared light impinging upon the sensor of the detector 3. The detector 3 has an output connected to a bandpass amplifier 5, which amplifies and filters the signal in the range of 0.1 to 10 Hz. The bandpass amplifier 5 has an output connected to an absolute value amplifier 7, which rectifies and amplifies the signal. The components of the system 1 described so far are well known in the art. It is preferable to have a detector 3 and amplifiers 5,7 providing a flat frequency response in the frequency range of 0.1 to 10 Hz.

The absolute value amplifier 7 has an output connected to a voltage controlled pulse generator 9 and an input of a comparator 11. The pulse generator 9 generates substantially uniform pulses at a frequency proportional to the voltage of the output of the amplifier 7. The comparator 11 compares the voltage of the signal from the output of the amplifier 7 with a reference voltage level 10. If the signal from amplifier 7 is greater than the preset reference level 10, then the comparator 11 produces an output signal. An AND gate 13 allows the pulse from generator 9 to pass only when the output from comparator 11 indicates that the level of the signal is above the reference level 10. Thus pulses are generated at an output of AND gate 13 only when the voltage of the signal of the output from amplifier 7 is above a threshold set by the reference 10. A timer 17 is reset by the output of the comparator 11 and has an output to indicate that the time interval as set by the reference 16 has elapsed. An integrator 15 counts the pulses output from AND gate 13, and has an output indicating an integral sum of the pulses. The integrator is reset by the output of the timer 17 passing via OR gate 17, which means that integrator 15 is reset (has its count set to zero) when the signal output from the amplifier 7 does not exceed the threshold set by reference 10 during an interval of time set by the reference 16. A comparator 19 compares the integral sum output from integrator 15 with the preset integral sum reference 18, and has an output indicating an alarm condition (alarm trigger) when the sum exceeds the reference 18. The output of the comparator 19 connects to a delay timer 20 which resets the integrator 15 through OR gate 17 after a time delay of 2 seconds, thus ending the alarm signal and starting a new integration cycle. The output of the comparator 19 connects further through output 21 to a display driver means (not shown) and through output 22 to an alarm driver means (not shown).

Figure 2:
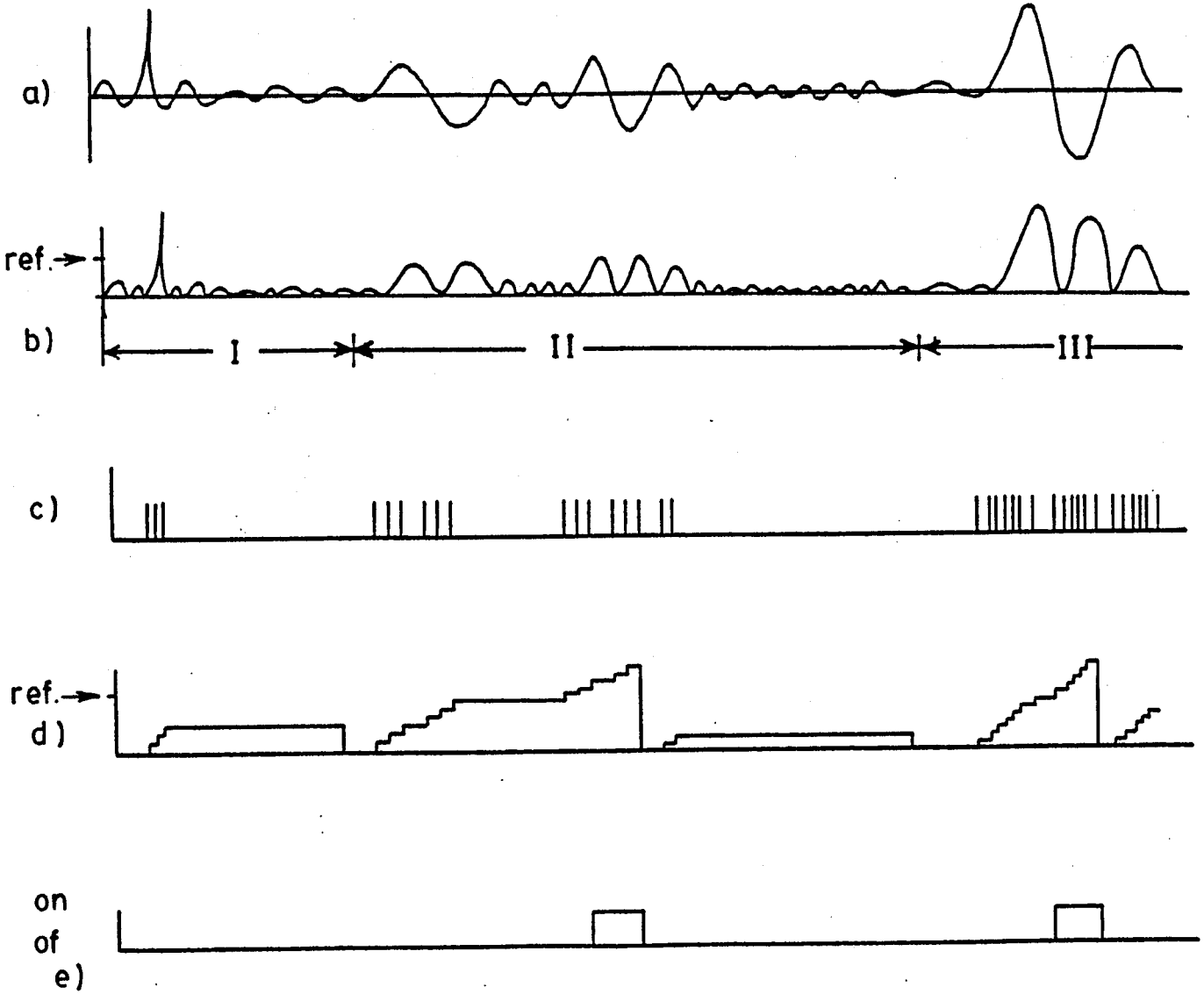
FIGS. 2a–2c show five exemplary signal segments.

The operation of the system 1 will now be described with reference to FIGS. 1 and 2. FIG. 2*a* shows a example signal from the output of bandpass amplifier 5. FIG. 2*b* shows the signal in 2*a* as rectified by absolute value amplifier 7, and indicates the three segments of the signal I, II and III as well as the threshold voltage level (ref.), as set by 10. The output from AND gate 13 is shown in FIG. 2*c*. It can be seen that the uniform pulses are generated at a frequency proportional to the signal amplitude in FIG. 2*b* only when the amplitude exceeds the threshold of reference 10. FIG. 2*d* shows the example output from the integrator 15, with integral sum reference (ref.), as set by 18 shown on the vertical axis. It can be seen that the integrator 15 is reset when no signal in FIG. 2*b* exceeds the threshold for the time interval set by the timer reference 16 in the case of segment I, or the reset occurs in FIG. 2*d* at the end of the time delay of 2 seconds set by the delay unit 20 after an alarm has been triggered in the segments II and III. FIG. 2*e* shows the output from the comparator 19 which is used to trigger an alarm. It can be seen that in FIG. 2*e* the signal is high when the integrator 15 reaches the level set by reference 18.

In segment I of FIG. 2, the detector 3 generates a high level noise pulse. This high level noise generates only three pulses in FIG. 2*c*, since the noise is high level but low energy. When the time interval set by reference 16 elaspes, timer 17 resets the integrator 15. No alarm is generated.

In segment II, the detector 3 produces a medium level signal as a result of intrusion. The signal is the result of a person moving through the zones 2 distant from the detector 3, producing two medium energy disturbances. The signal surpasses the threshold, and generates pulses shown in FIG. 2*c*. The integrator 15 produces an integral sum which exceeds the reference 18 when the second medium energy disturbance is detected, as shown in FIG. 2*d*, and the comparator 19 produces the alarm signal as shown in FIG. 2*e*. The alarm signal lasts for 2 seconds as determined by the delay 20 which resets the integrator 15.

In segment III, the detector 3 produces a strong signal as a result of intrusion. The signal is the result of a person moving through the zones 2 close to the detector 3, producing a strong disturbance. The integrator 15 reaches the required reference level 18 quickly, as shown in FIG. 2*d*, and the alarm trigger output is generated as shown in FIG. 2*e*.

In FIG. 2, the reference levels have been chosen arbitrarily for clarity in the Figure. The actual values in the preferred embodiment for the signals of FIG. 2 are as follows. The signal in FIG. 2*a* is generated from amplifying the signal from a pyroelectric sensor 5000 times with a flat frequency response, and filtering the signal to bandpass the range 0.1 to 10 Hz. The signal in FIG. 2*b* is a positive (rectified) signal from 0 V to 5 V, and is proportional to the infrared signal detected by the detector 3. The pulses in FIG. 2*c* are generated by the pulse generator 9, which produces pulses at 100 Hz at 5 V input with 50% duty cycle. As the input tends to 0 V, the frequency tends to 0 Hz and the duty cycle to 0%, the pulses generated having substantially the same pulse width. The integrator 15 may be a digital adder or an analog integrator as known in the art. The reference set by 10 is 1 V, the reference set by 16 normally is between 20s and 60s, although it may be as short as 5 seconds and much longer such as 10 minutes, and the reference set by 18 is 100 pulses. The output of the AND gate 13 can be connected to a display device, such as an LED (not shown), which will indicate signal detection. The output of the AND gate 13 can also be connected to a remote monitoring or signal processing device, since the output is digital.

It can be understood from the above description of the preferred embodiment, that the present invention provides a signal processing unit that takes into consideration the strength and time duration of the sensor output (related to the energy of the signal). The signal processing according to the invention is a smart adaptive processing which measures in fact the size, time and shape of the detected signal to generate an alarm signal. Furthermore, the system according to the invention is not much more expensive than the prior art passive infrared detection systems, while achieving a much higher accuracy of alarm detection.

Although the above description refers to the integration of pulses, it is of course possible to integrate the signal output from the absolute value amplifier 7, which is substantially linearly proportional to the intensity of the infrared radiation received by the pyroelectric sensor of the detector 5, by direct means (i.e. without converting the amplitude voltage into pulses by the voltage controlled oscillator 9).

It is to be understood that above description of the invention is not intended to limit the invention, whose scope is defined in the appended claims.

The embodiments of the invention in which an exclusive property or privilege is claimed are defined as follows:

1. A passive infrared intrusion detection system to be connected to an alarm, comprising:

collecting means for collecting infrared rays having an intensity from a plurality of optically divided detection zones of an area to be monitored;

detector means for passively detecting said infrared rays collected by said collecting means;

generating means for generating a signal proportional to the intensity of said infrared rays collected by said collecting means;

integration means for integrating said signal to produce an integral sum, and for generating an output signal when the integral sum produced by said integration means during an integration period exceeds a preset value; and alarm activating means for activating said alarm in response to said output signal of said integration means.

2. A detection system according to claim 1, wherein said generating means generates pulses at a frequency proportional to the intensity of said infrared rays.

3. A detection system according to claim 2, wherein said generating means generates pulses only when said intensity exceeds a predetermined level.

4. A detection system according to claim 2, further comprising a timer for timing a time interval, connected to said integration means to monitor said integration period, said timer being reset when said intensity exceeds a predetermined level, so that said integration means is reset when said intensity of said signal remains below said predetermined level during said time interval.

5. A detection system according to claim 4, wherein said time interval is between 5 seconds and 10 minutes.

6. A detection system according to claim 4, wherein said time interval is between 20 seconds and 1 minute.

7. A detection system according to claim 2, wherein said generating means includes a high frequency voltage controlled oscillator.

8. A detection system according to claim 2, wherein said generating means includes a bandpass amplifier having a frequency range of substantially 0.1 to 10 Hz.

9. A detection system according to claim 2, wherein said pulses are substantially uniform.

10. A detection system according to claim 9, wherein said generating means generates pulses only when said intensity exceeds a predetermined level.

11. A detection system according to claim 9, wherein said integration means includes a digital counter.

12. A method of passive infrared intrusion detection, comprising the steps of:

a) collecting infrared rays having an intensity from a plurality of optically divided detection zones of an area to be monitored;

b) detecting said infrared rays collected in step (a);

c) generating a signal proportional to the intensity of said infrared rays detected in step (b);

d) integrating said signal during an integration period to produce an integral sum;

e) generating an output signal when the integral sum in step (d) exceeds a preset value;

f) activating an alarm in response to said output signal generated in step (e).

13. A method of passive infrared intrusion detection according to claim 12, wherein in said step (c) said signal comprises pulses generated at a frequency proportional to the intensity of said infrared rays.

14. A method of passive infrared intrusion detection according to claim 13, wherein step (c) includes a step of generating said pulses only when said intensity exceeds a predetermined level.

15. A method of passive infrared intrusion detection according to claim 13, wherein said integral sum in step (d) is reset when said intensity of said infrared rays collected in step (a) remains below a predetermined level during a predetermined time interval.

16. A method of passive infrared intrusion detection according to claim 15, wherein said time interval is between 5 seconds and 10 minutes.

17. A method of passive infrared intrusion detection according to claim 15, wherein said time interval is between 20 seconds and 1 minute.

18. A method of passive infrared intrusion detection according to claim 13, wherein said pulses generated in step (c) are substantially uniform.

19. A method of passive infrared intrusion detection according to claim 18, wherein said pulses are generated only when said intensity exceeds a predetermined level.

20. A method of passive infrared intrusion detection according to claim 18, wherein said pulses are integrated by counting said pulses.

* * * * *